US010329858B1

(12) United States Patent
He et al.

(10) Patent No.: US 10,329,858 B1
(45) **Date of Patent: *Jun. 25, 2019**

(54) COILED TUBING UNIT

(71) Applicant: JIANGHAN MACHINERY RESEARCH INSTITUTE LIMITED COMPANY OF CNPC, Jingzhou Hubei (CN)

(72) Inventors: Huiqun He, Wuhan Hubei (CN); Gao Yang, Wuhan Hubei (CN); Shoujun Liu, Wuhan Hubei (CN); Xuehui Li, Wuhan Hubei (CN); Ge Xiong, Wuhan Hubei (CN); Shibin Zhang, Wuhan Hubei (CN); Jun Hao, Wuhan Hubei (CN); Heping Cao, Wuhan Hubei (CN); Wenyi Duan, Wuhan Hubei (CN); Zhiqiang Hu, Wuhan Hubei (CN); Jiafu Yan, Wuhan Hubei (CN); Zhimin Yang, Wuhan Hubei (CN); Fei Liu, Wuhan Hubei (CN); Zhongcheng Zhou, Wuhan Hubei (CN)

(73) Assignee: JIANGHAN MACHINERY RESEARCH INSTITUTE LIMITED COMP, Hubei (CN)

( * ) Notice: Subject to any disclaimer, the term of this patent is extended or adjusted under 35 U.S.C. 154(b) by 0 days.

This patent is subject to a terminal disclaimer.

(21) Appl. No.: 16/140,050

(22) Filed: Sep. 24, 2018

(51) Int. Cl.
*E21B 19/22* (2006.01)

(52) U.S. Cl.
CPC ..... *E21B 19/22* (2013.01); *B65H 2701/33* (2013.01)

(58) Field of Classification Search
CPC ..... E21B 19/22; B65H 2701/33; B65H 75/40; B65H 75/403
See application file for complete search history.

(56) References Cited

U.S. PATENT DOCUMENTS

2004/0244993 A1* 12/2004 Crawford ..... E21B 15/00 166/381
2012/0247579 A1* 10/2012 Park ..... B65H 75/38 137/355.26

FOREIGN PATENT DOCUMENTS

CN 103711448 A 4/2014

* cited by examiner

*Primary Examiner* — James G Sayre
(74) *Attorney, Agent, or Firm* — Calfee Halter & Griswold LLP

(57) ABSTRACT

The present invention relates to the field of petroleum extraction equipment, and discloses a coiled tubing unit, which comprises a vehicle body (T), a control cab (30), a coiled tubing reel (10) configured to wind coiled tubing, and a power skid (20) configured to supply power to the coiled tubing reel (10) and transported separately, wherein, the coiled tubing reel (10) and the control cab (30) are mounted on the vehicle body (T). With the coiled tubing unit provided in the present invention, the total length and total weight of the vehicle body on which the coiled tubing reel is mounted are smaller and can meet the requirements for transportation in regions where smaller vehicle dimensions and weight are specified for transportation when coiled tubing in large diameter and/or great length is transported, and the coiled tubing unit is adaptive to the operating habits, and can be deployed flexibly so that it can be used in a well field where the space is limited.

14 Claims, 9 Drawing Sheets

COILED TUBING UNIT

FIELD OF THE INVENTION

The present invention relates to the field of petroleum extraction equipment, particularly to a coiled tubing unit.

BACKGROUND OF THE INVENTION

Presently, coiled tubing unit within 2 in-6,000 m specification are matured domestically and abroad, form a variety of structural types including vehicle-mounted structure, skid-mounted structure, and trailer-mounted structure, and can meet the requirements for use in different regions. However, the coiled tubing unit which can hold coiled tubing above 2 in-6,000 m specification or 2 in-8,000 m specification are only available in a smaller number of countries such as USA and Canada, etc., but are not used in China and many other countries and regions yet. Such coiled tubing unit usually use a semi-trailer-mounted structural type, and some of them use an all-in-one trailer-mounted structure (i.e., all devices are disposed on a semi-trailer) to reduce the number of vehicles required for transportation. Consequently, the vehicles are in a large overall size, extra high, extra wide, and extra heavy. For instance, the 2 in-7,600 m coiled tubing unit from National Oilwell Varco (NOV) is in 5 m height and 33 m length. Such coiled tubing unit can be used in regions where the road conditions and transportation regulations permit, but can't be used in countries and regions where the road conditions are limited or the transportation regulations forbid. For example, in China, the road transportation regulations specify that general-purpose transportation vehicles shall be in width≤2,550 mm and in height≤4,000 mm and special over-limit transportation vehicles shall be in width≤3,000 mm and in height≤4,500 mm. Moreover, vehicles in extra-large dimensions have higher requirements for well fields, and can't be used in well fields where the space is limited.

Hence, there is a demand for a coiled tubing unit, which can meet the requirements for transportation in regions where smaller vehicle dimensions and weight are specified for transportation when coiled tubing in large diameter and/or great length is transported, and is adaptive to the habits of operation and can be deployed flexibly so that it can be used in a well field where the space is limited.

SUMMARY OF THE INVENTION

To solve the problems in the prior art, i.e., the existing coiled tubing unit for coiled tubing in large diameter and/or great length can't meet the requirements for transportation in regions where smaller vehicle dimensions and weight are specified for transportation, are inconvenient to operate, and can't be deployed flexibly to use in a well field where the space is limited, the present invention provides a coiled tubing unit, which can meet the requirements for transportation in regions where smaller vehicle dimensions and weight are specified for transportation when coiled tubing in large diameter and/or great length is transported, and is adaptive to the habits of operation and can be deployed flexibly to use in a well field where the space is limited.

To attain the above object, the present invention provides a coiled tubing unit, which comprises a vehicle body, a control cab, a coiled tubing unit configured to wind coiled tubing, and a power skid configured to supply power to the coiled tubing unit and transported separately, wherein, the coiled tubing reel and the control cab are mounted on the vehicle body.

In the above technical scheme, since the power system is arranged separately on a skid (power skid) and transported separately, the power skid doesn't occupy a space on the vehicle body where the coiled tubing unit is mounted. Such an arrangement is helpful for reducing the total length and total weight of the vehicle body, increases the winding capacity of coiled tubing on the coiled tubing reel, enables the vehicle body to meet the requirements for transportation in regions where smaller vehicle dimensions and weight are specified for transportation when coiled tubing in large diameter and/or great length is transported; in addition, since the control cab and the coiled tubing unit are transported on one vehicle, it is convenient to observe the coiled tubing reel in the control cab during operation process, thus the operating habits can be guaranteed; moreover, since the power skid is transported separately while the control cab and the coiled tubing reel are transported together on another vehicle, the power skid and the vehicle body on which the control cab and the coiled tubing reel are mounted can be deployed conveniently and flexibly, so that the coiled tubing unit can be used in a well field where the space is limited. The coiled tubing unit provided in the present invention overcomes the drawback that the existing large-diameter ultra-high-capacity coiled tubing units are inconvenient to transport and can't be deployed flexibly to use in well fields where the space is limited in the prior art, realize the application of deep wells and extra-deep wells, and are helpful for saving costs and improving economic benefits.

Other features and advantages of the present invention will be further detailed in the embodiments hereunder.

BRIEF DESCRIPTION OF DRAWINGS

The accompanying drawings are provided here to facilitate further understanding on the present invention, and constitute a part of this document. They are used in conjunction with the following embodiments to explain the present invention, but shall not be comprehended as constituting any limitation to the present invention. In the figures.

BRIEF DESCRIPTION OF SYMBOLS

Figure 1:
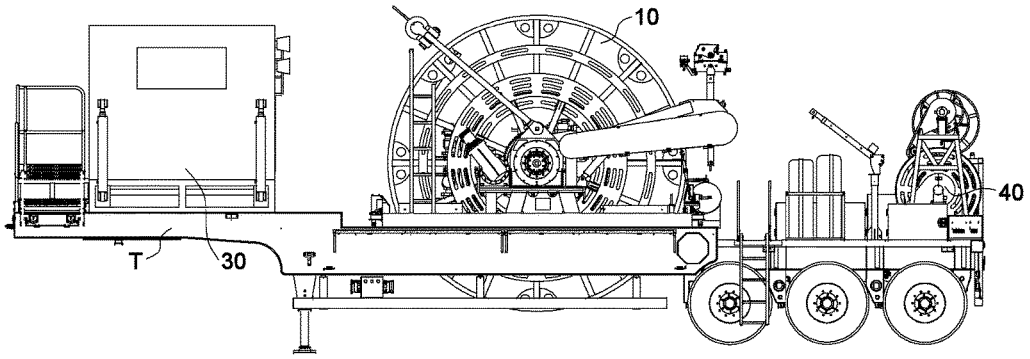
FIG. 1 is a schematic diagram of a part of the structure of the vehicle body on which a coiled tubing reel and a control cab are mounted in a preferred embodiment of the present invention.

10—coiled tubing reel; 20—power skid; 201—diesel engine; 202—transfer case; 203—hydraulic pump; 204—hydraulic oil tank; 205—accumulator; 206—generator; 207—power hose reel; 208—short pipeline hose reel; 30—control cab; 40—control hose reel; 500—transport skid; 501—injection head; 502—gooseneck; 503—blowout preventer; 504—stripper; 505—lubricator; T—vehicle body; 60—tower; 601—bottom platform; 602—middle support; 603—top injection head mounting platform; 1—drum assembly; 11—drum; 111—reel support; 1111—annular cylinder; 1112—radial column; 1113—axial column; 1114—circumferential column; 112—spoke wheel; 12—reel shaft; 13—transmission gear; 14—first bearing block; 15—second bearing block; 16—housing; 2—driving component; 21—driving gear; 22—motor; 23—reducer; 3—frame-shaped base; 4—braking component; 41—mounting base; 42—slide block; 43—friction disk; 44—screw rod; 45—supporting member; 46—lock nut; K—dovetail block; 47—stopper; T—flange; 5—levelwind assembly; 51—first linking arm; 52—second linking arm; 53—leadscrew; 54—first sprocket; 55—second sprocket; 56—forced alignment motor; 57—slide tongue box assembly; 58—roller bogie; 59—adjustable counter; 50—lubricant box; 6—clutch component; 61—driving portion; 611—driving shaft; 612—driving sprocket; 62—driven portion; 621—driven shaft; 622—driven sprocket; 63—clutch portion; 64—switching portion; 7—elevating component; 8—hoisting device; 9—container locking base; P1—internal plumbing installation; P2—external plumbing installation; F—check valve.

DETAILED DESCRIPTION OF THE EMBODIMENTS

Hereunder some embodiments of the present invention will be detailed with reference to the accompanying drawings. It should be understood that the embodiments described here are only provided to describe and explain the present invention, but shall not be deemed as constituting any limitation to the present invention.

In the present invention, unless otherwise specified, the terms that denote the orientations are used as follows, for example: "top", "bottom", "left" and "right" usually refer to "top", "bottom", "left" and "right" as shown in the accompanying drawings; "inside" and "outside" refer to inside and outside in relation to the profiles of the components.

The present invention provides a coiled tubing unit, which comprises a vehicle body T, a control cab 30, a coiled tubing reel 10 configured to wind coiled tubing, and a power skid 20 configured to supply power to the coiled tubing reel 10 and transported separately, wherein, the coiled tubing reel 10 and the control cab 30 are mounted on the vehicle body T. Thus, the control cab 30 and the coiled tubing reel 10 are transported on one vehicle, while the power skid 20 is transported separately.

In the above technical scheme, since the power system is arranged separately on a skid (power skid 20) and transported separately, the power skid 20 doesn't occupy a space on the vehicle body T where the coiled tubing reel 10 is mounted. Such an arrangement is helpful for reducing the total length and total weight of the vehicle body T, increases the winding capacity of coiled tubing on the coiled tubing reel 10, enables the vehicle body T to meet the requirements for transportation in regions where smaller vehicle dimensions and weight are specified for transportation when coiled tubing in large diameter and/or great length is transported; in addition, since the control cab 30 and the coiled tubing reel 10 are transported on one vehicle, it is convenient to observe the coiled tubing reel 10 in the control cab 30 during operation process, thus the operating habits can be guaranteed; moreover, since the power skid 20 is transported separately while the control cab 30 and the coiled tubing reel 10 are transported together on another vehicle, the power skid 20 and the vehicle body T on which the control cab 30 and the coiled tubing reel 10 are mounted can be deployed conveniently and flexibly, so that the coiled tubing unit can be used in a well field where the space is limited. The coiled tubing unit provided in the present invention overcomes the drawback that the existing large-diameter ultra-high-capacity coiled tubing unit is inconvenient to transport and can't be deployed flexibly to use in well fields where the space is limited in the prior art, realizes the application of deep wells and extra-deep wells, and is helpful for saving costs and improving economic benefits.

As shown in FIG. 1, preferably, a control hose reel 40 is further mounted on the vehicle body T, the control cab 30 and the control hose reel 40 are mounted on opposite sides of the coiled tubing reel 10 respectively, and the control cab 30 is mounted near a front portion of the vehicle body T away from the tail end of the vehicle body T, and the control hose reel 40 is disposed on or near the tail end of the vehicle body T, to facilitate the operator to operate; wherein, the control hose reel 40 may comprise a injection head control hose reel and a blowout preventer control hose reel, and other accessories such as ladder and toolbox, etc. may be mounted on the vehicle body T.

Figure 2:
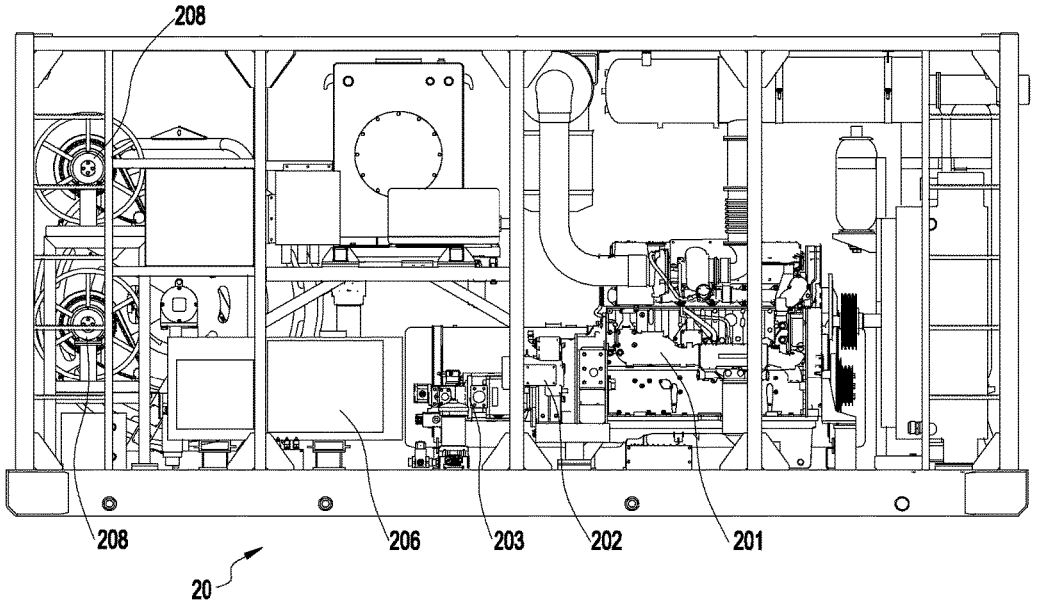
FIG. 2 is a schematic structural diagram of the power skid in the preferred embodiment of the present invention.
Figure 3:
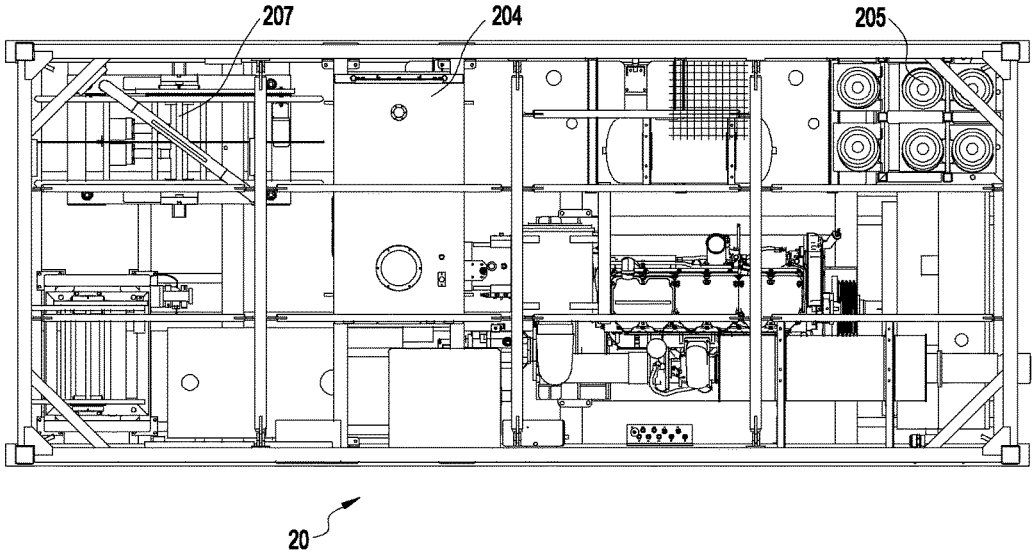
FIG. 3 is a schematic structural diagram of the power skid viewed at a different viewing angle in the preferred embodiment of the present invention.

As shown in FIGS. 2 and 3, the power skid 20 comprises a diesel engine 201, a transfer case 202, a hydraulic pump 203, a hydraulic oil tank 204, an accumulator 205, a generator 206, a power hose reel 207, and a short pipeline hose reel 208 configured to wind hydraulic pipelines between the power skid 20 and the coiled tubing reel 10; thus, the hydraulic pipelines can be connected and stored conveniently, and one or more short pipeline hose reels 208 may be provided as required; wherein, the diesel engine 201 is connected with the transfer case 202, the hydraulic pump 203 is mounted on the transfer case 202, the hydraulic oil tank 204 is mounted above the hydraulic pump 203, the power hose reel 207 and the short pipeline hose reel 208 are mounted on a first side of the power skid 20, the generator 206 is mounted between the short pipeline hose reel 208 and the diesel engine 201, and the accumulator 205 is mounted on a second side of the power skid 20 opposite to the first side. Thus, the power skid system 20 is compact in structure and smaller in size, can be transported conveniently, and can be deployed flexibly in a well field where the space is limited.

Figure 4:
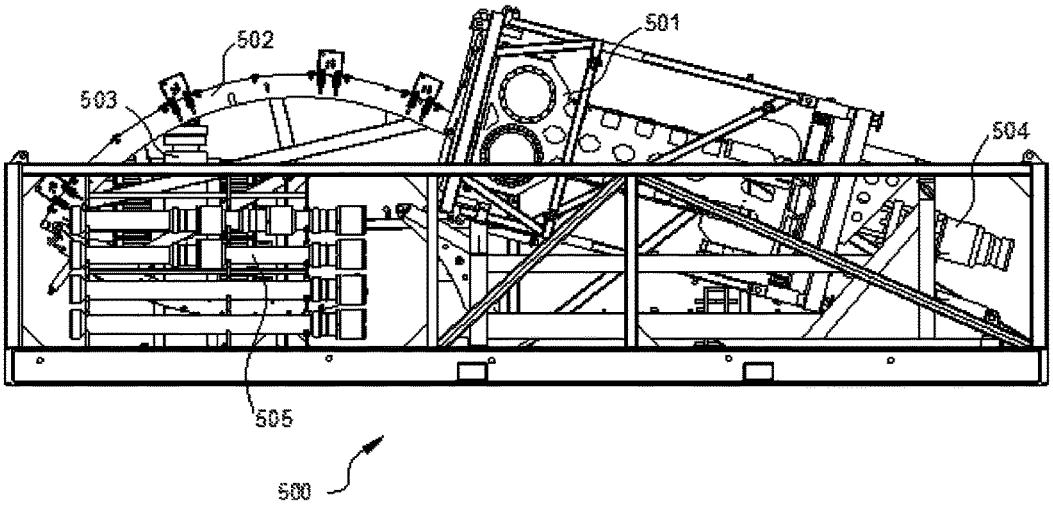
FIG. 4 is a schematic structural diagram of the transport skid in the preferred embodiment of the present invention.

As shown in FIG. 4, preferably, the coiled tubing unit comprises a transport skid 500 on which an injection head 501, a gooseneck 502, a blowout preventer 503, a stripper 504, and a lubricator 505 can be disposed together and transported integrally, and the power skid 20 can supply power to the injection head 501, the stripper 504, and the blowout preventer 503 on the transport skid 500; wherein, the injection head 501 is used to take out a coiled tubing from an oil and gas well or insert a coiled tubing into an oil and gas well, the gooseneck 502 is used to guide the coiled tubing, the blowout preventer 503 is used to close the well timely to prevent leakage of toxic and harmful oil or gas in a case of well blowout, and the stripper 504 is used to seal the oil and gas well dynamically when the coiled tubing is taken out or inserted. Further preferably, the gooseneck 502 is mounted on the top of the injection head 501, the stripper 504 is mounted on the bottom of the injection head 501, wherein the gooseneck 502 and the stripper 504 does't need to remove during transportation so as to reduce the time of mounting and removal, the blowout preventer 503 and the lubricator 505 are mounted on two sides of the gooseneck 502 respectively, and the lubricator 505 can be connected to the blowout preventer 503 and the stripper 504 respectively during operation. In such an arrangement, the transport skid 500 is compact in structure and smaller in size, can be transported conveniently, and can be deployed flexibly in a well field where the space is limited.

Figure 5:
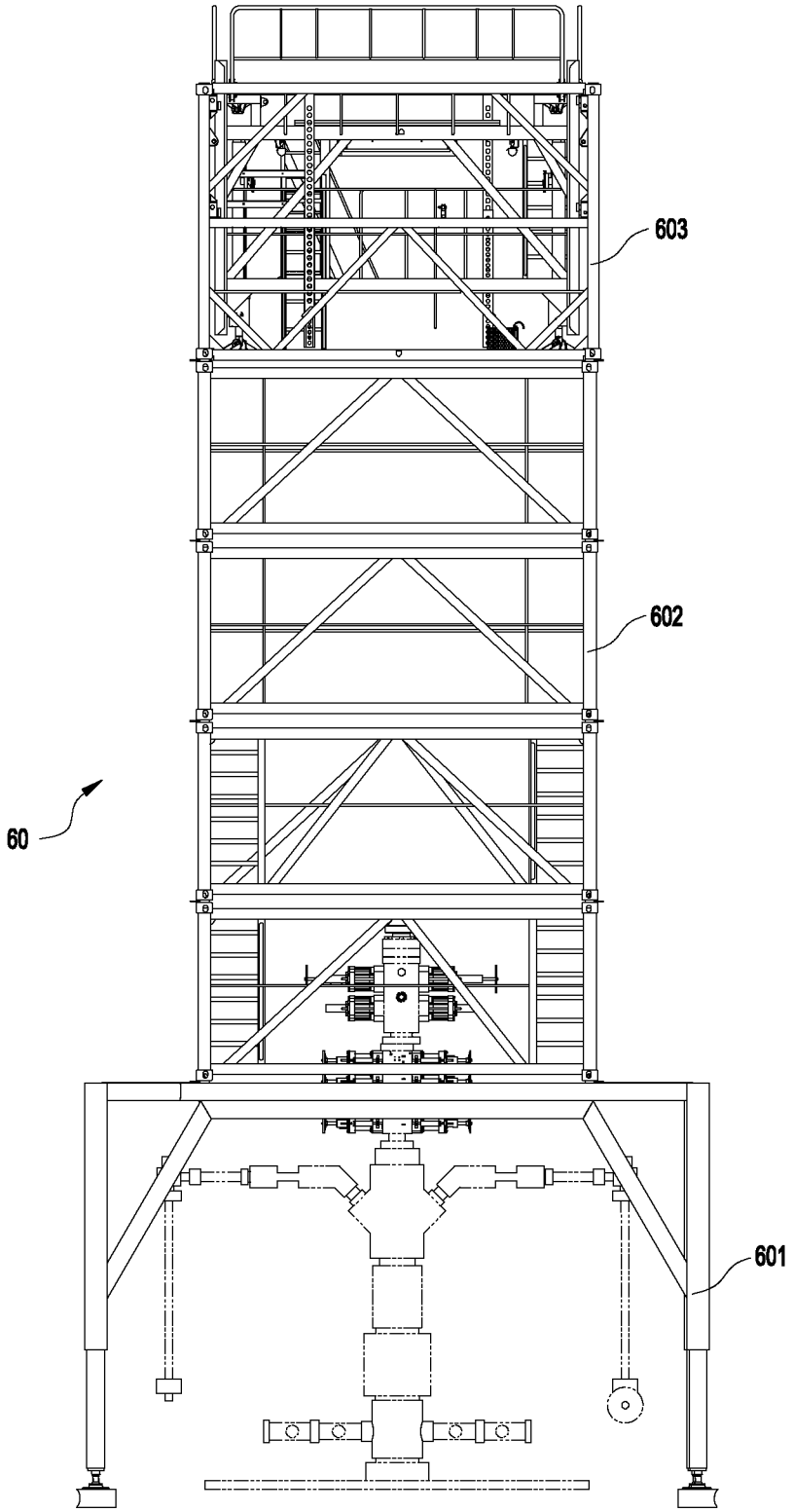
FIG. 5 is a schematic structural diagram of the tower in the preferred embodiment of the present invention.

Moreover, the coiled tubing unit may further comprises a tower 60, as shown in FIG. 5, which mainly comprises a bottom platform 601, a middle support 602, and a top injection head mounting platform 603. The height of the bottom platform 601 is adjustable to adapt to different height of the well top elevations; the middle support 602 consists of a plurality of identical supports, which can be combined freely to adapt to the mounting height of different injection heads 501; the top injection head mounting platform 603 can be moved laterally so that the injection head 501 is mounted in alignment to the center of the well top, and the top injection head mounting platform 603 can be moved vertically to meet the height requirement when the blowout prevention system is connected to the well top; meanwhile, the top injection head mounting platform 603 can be rotated within a certain range of angle, so as to correct the angular position of the gooseneck 502 and the coiled tubing reel 10 in a well field where the mounting space is limited.

Figure 6:
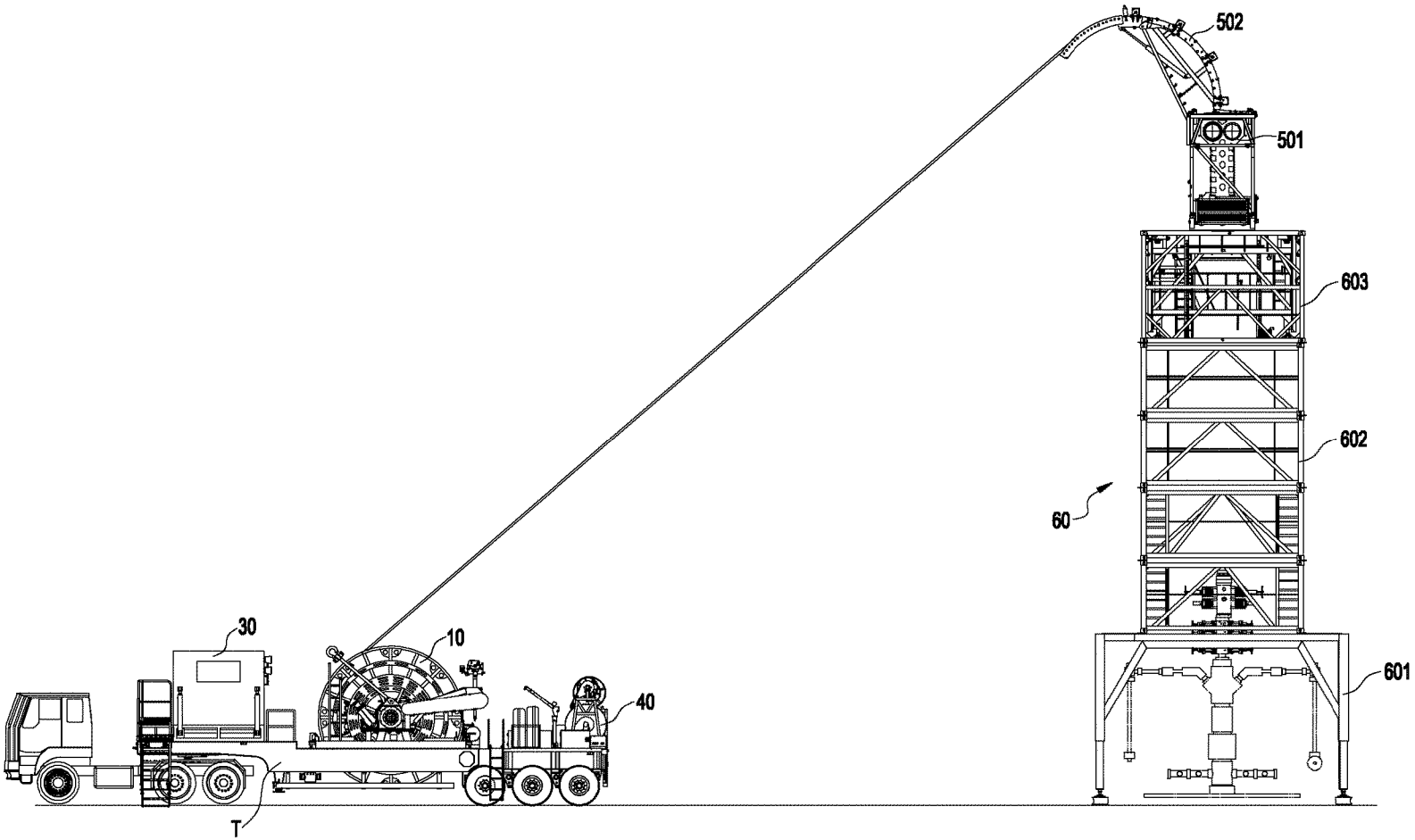
FIG. 6 is a schematic diagram of a part of the structure of the coiled tubing unit in the preferred embodiment of the present invention.

Wherein, the vehicle body T may be a semi-trailer in a frame structural form, which is transported by means of a towing vehicle; the power skid 20, the transport skid 500, and the tower 60 may be transported on trucks or semi-trailers. After the coiled tubing unit is transported to a well field, the vehicle body T (the coiled tubing reel 10 and the control cab 30 are mounted on it), the power skid 20, the transport skid 500, and the tower 60 may be deployed according to the conditions of the well field. FIG. 6 shows an assembly view of the injection head 501, the tower 60, and the coiled tubing reel 10 mounted on the vehicle body T. In addition, the tower 60 may be assembled and mounted according to the height of the well top for the operation, and the deployment position of the power skid 20 and the transport skid 500 are not confined by the position of the well top. With the one-trailer and three-skid structural form of the coiled tubing unit (wherein, "one-trailer" refers to a semi-trailer on which the coiled tubing reel 10 and the control cab 30 are disposed; "three-skid" refers to the power skid 20, the transport skid 500, and the tower 60), the power skid 20, the transport skid 500, and the tower 60 are transported separately, the dimensions and weight of the vehicle body T on which the coiled tubing reel 10 and the control cab 30 are mounted are reduced, and the coiled tubing transportation capability of the vehicle body T is maximized; in addition, since the control cab 30 and the coiled tubing reel 10 are transported on one vehicle, it is convenient to observe the coiled tubing reel 10 in the control cab 30 during operation process, thus the operating habits can be guaranteed; moreover, since the power skid 20, the transport skid 500, and the tower 60 are transported separately while the control cab 30 and the coiled tubing reel 10 are transported together on one vehicle, the coiled tubing unit can be transported flexibly under different road transportation conditions, and the power skid 20, the transport skid 500, the tower 60, and the vehicle body T on which the control cab 30 and the coiled tubing reel 10 are mounted can be deployed flexibly and conveniently in a well field where the space is limited, thereby the drawbacks that existing large-diameter ultra-high-capacity coiled tubing unit is inconvenient to transport and can't be deployed flexibly to use in well fields where the space is limited are overcome, the application of deep wells and extra-deep wells is realized, and is helpful for reducing costs and improving economic benefits.

Figure 7:
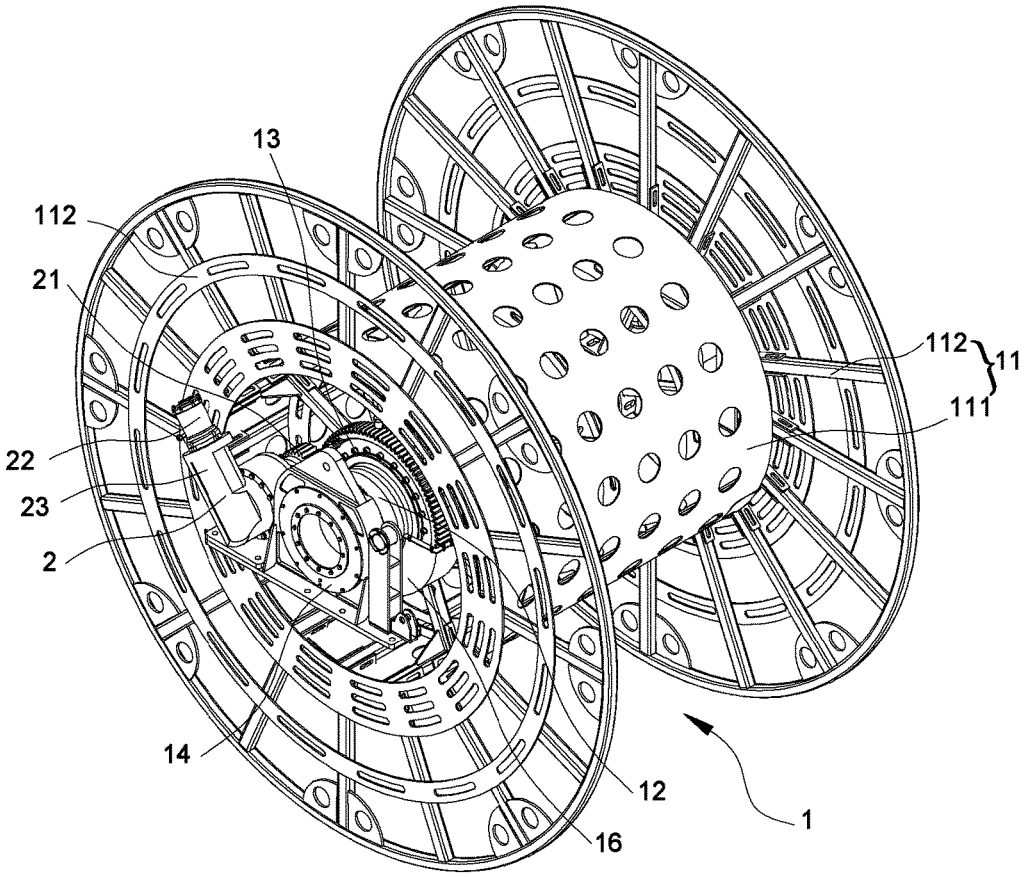
FIG. 7 is a schematic diagram of a part of the structure of the coiled tubing reel in a preferred embodiment of the present invention.

Preferably, as shown in FIG. 7, the coiled tubing reel 10 comprises a drum assembly 1 configured to wind a coiled tubing and a driving component 2 configured to drive the drum assembly 1, wherein, the power skid 20 can supply power to the driving component 2, the drum assembly 1 comprises a drum 11, a reel shaft 12, a transmission gear 13, and a first bearing block 14 and a second bearing block 15 that are oppositely arranged and spaced from each other and are fixed relative to the vehicle body T, wherein the drum 11 is fixedly fitted on the reel shaft 12, the two ends of the reel shaft 12 are rotatably arranged on the first bearing block 14 and the second bearing block 15 respectively, the transmission gear 13 is fixed with respect to the reel shaft 12 to drive the reel shaft 12 to rotate, the driving component 2 is fixedly arranged on the first bearing block 14 and is at least partially disposed inside the drum 11, and the driving component 2 comprises a driving gear 21 that is engaged with the transmission gear 13, and preferably, the driving component 2 further comprises a motor 22 and a reducer 23 that is connected between the motor 22 and the driving gear 21 and fixedly arranged on the first bearing block 14, and at least a part of the structure of the reducer 23 is disposed inside the drum 11. In addition, the driving component 2 may be fixedly connected to the first bearing block 14 by bolts. Since the transmission gear 12 is fixed with respect to the reel shaft 12 to drive the reel shaft 12 to rotate, the driving component 2 comprises a driving gear 21 engaged with a transmission gear 13, and the driving component 2 is fixedly arranged on the first bearing block 14 and at least partially disposed inside the drum 11, such that the coiled tubing reel 10 has a compact structure and is small in size, the width of the drum 11 in the axial direction can be increased while the requirement for transportation dimensions is met, and thereby the coiled tubing winding capacity can be increased; besides, since a gear driving mode is used, the transmission torque is high, the coiled tubing reel can operate smoothly and steadily at a low speed, and the drum 11 can be replaced conveniently.

Figure 10:
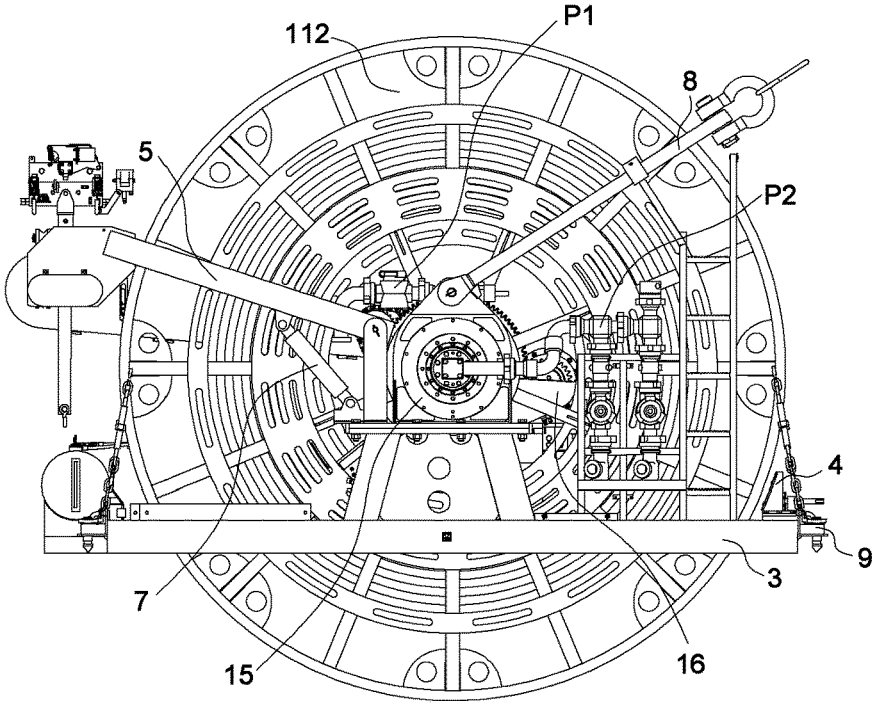
FIG. 10 is a right view of the coiled tubing reel in the preferred embodiment of the present invention.

In view that the transmission gear 13 is large in size and it is inconvenient to directly fix the transmission gear 13 to the reel shaft 12, preferably, the drum assembly 1 comprises a flange that is fixedly fitted on the reel shaft 12 and fixedly connected to the drum 11, so that the transmission gear 13 can be fixed with respect to the reel shaft 12 conveniently. The flange may be connected to the gear shaft 12 and the drum 11 (e.g., radial columns 1112 described below) by welding, the transmission gear 13 may be fitted on the reel shaft 12 and fixedly connected to the flange. For example, the transmission gear 13 may be fixedly connected to the flange by bolts. In addition, to reduce the wear between the driving gear 21 and the transmission gear 13 and make the transmission more smooth and steady, as shown in FIGS. 7 and 10, the drum assembly 1 further comprises an housing 16 outside the driving gear 21 and the transmission gear 13, wherein the housing 16 accommodates lubricant inside it and is fixed with respect to the first bearing block 14, and the housing 16 has an opening; the diameter of the flange is smaller than the diameter of the transmission gear 13, the flange extends out from the opening, and there is clearance between the flange and the opening. In that way, the flange can rotate together with the reel shaft 12, while the housing 16 doesn't rotate together with the reel shaft 12.

Figure 8:
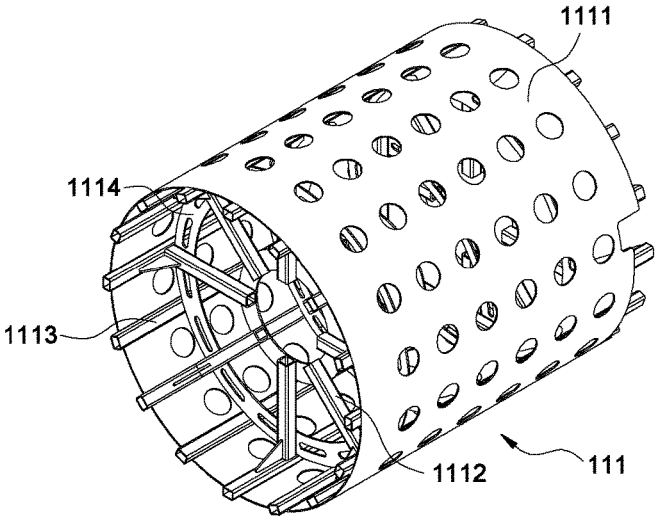
FIG. 8 is a schematic structural diagram of the reel support in the preferred embodiment of the present invention.

Furthermore, to fixedly connect the flange to the drum 11 conveniently and reduce the weight of the drum 11 so as to increase the weight of wound coiled tubing, as shown in FIGS. 7 and 8, preferably, the drum 11 comprises a reel support 111 configured to wind the coiled tubing and spoke wheels 112 arranged on the two ends of the reel support 111, the reel support 111 comprises an annular cylinder 1111 and a plurality of radial columns 1112 that are arranged at an interval in the circumferential direction of the annular cylinder 1111 and extends in the radial direction of the annular cylinder 1111, the two ends of each radial column 1112 are fixedly connected to the annular cylinder 1111 and the reel shaft 12 respectively, and the flange is fixedly connected to the radial columns 1112. Here, it should be noted: since the driving gear 21 and the transmission gear 13 require lubrication with lubricant during their operation, usually the above-mentioned housing 16 that accommodates lubricant is arranged outside the driving gear 21 and the transmission gear 13. Consequently, the transmission gear 13 can't be directly connected to the radial columns 1112 by welding; instead, a space for mounting the housing 16 has to be reserved. Therefore, the transmission gear 13 may be indirectly connected to the radial columns 1112 via the above-mentioned flange. In addition, to ensure the structural strength of the reel support 111, the reel support 111 further comprises a plurality of axial columns 1113 that are arranged at an interval in the circumferential direction of the annular cylinder 1111 and extend in the axial direction of the annular cylinder 1111 and/or a plurality of circumferential columns 1114 that are arranged at an interval in the axial direction of the annular cylinder 1111 and extend in the circumferential direction of the annular cylinder 1111. Wherein, the circumferential columns 1114 may be in an annular shape, and the radial columns 1112, axial columns 1113, and circumferential columns 1114 may be made of square steel.

Figure 9:
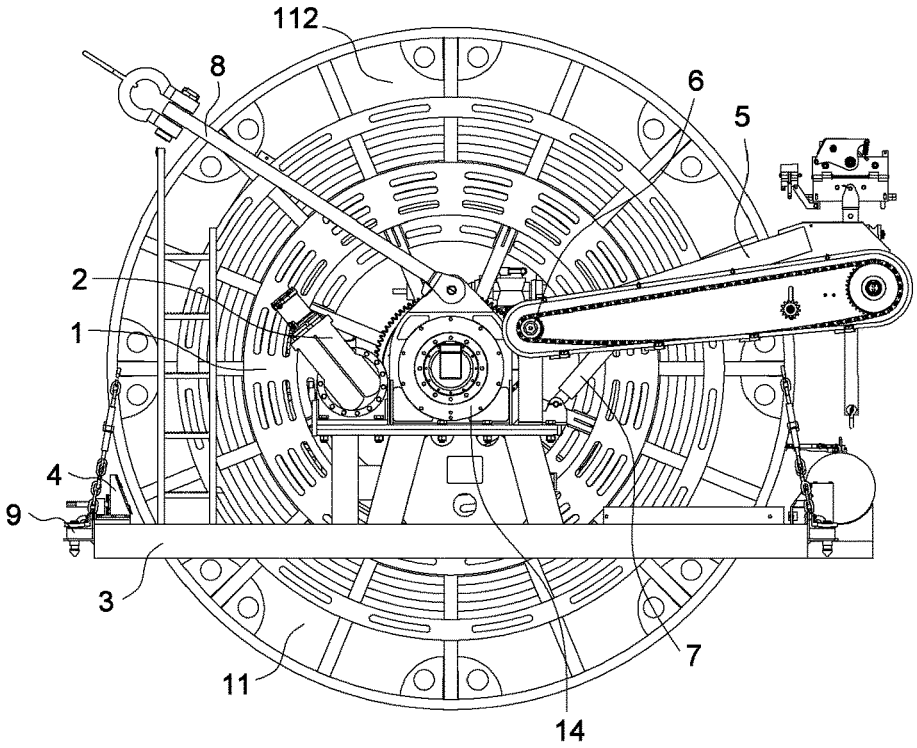
FIG. 9 is a left view of the coiled tubing reel in the preferred embodiment of the present invention.

To further increase the coiled tubing winding capacity of the drum 11, as shown in FIGS. 9 and 10, preferably, the coiled tubing reel 10 comprises a frame-shaped base 3 fixed relative to the vehicle body T, the drum 11 is fitted inside the frame-shaped base 3, and the first bearing block 14 and the second bearing block 15 are arranged on two opposite side edges of the frame-shaped base 3. When the coiled tubing reel 10 is mounted on a vehicle body for transportation, the frame-shaped base 3 may be directly fixed to the vehicle body. For example, the frame-shaped base 3 may be fixed to a trailer by means of a container locking base 9. In addition, the vehicle body may have a space for accommodating the part of the drum 11 below the frame-shaped base 3 (at the side away from the reel shaft 12), and thereby the height of the drum 11 on which the coiled tubing is wound can be decreased, which is to say, the coiled tubing winding capacity of the drum 11 can be increased. Moreover, to mount the drum assembly 1 on the vehicle body conveniently, a hoisting device 8 may be mounted on the drum 11, and the two ends of the hoisting device 8 may be hinged via a pin shaft to the first bearing block 14 and the second bearing block 15 respectively. Besides, as shown in FIG. 10, an internal plumbing installation P1 configured to connect the coiled tubing and an external plumbing installation P2 configured to connect an external pump truck may be arranged on the second bearing block 15.

The drum 11 may produce high rotational inertia impact under road conditions in the transportation process of the coiled tubing reel 10, and, if chain tighteners are used to fix the drum 11, the chains and hangers of the chain tighteners may be deformed or broken easily, and consequently the drum 11 can't be fixed reliably. In view of that problem, to fix the drum 11 reliably, as shown in FIGS. 7, 8, 9, and 10, preferably, the drum 11 comprises a reel support 111 configured to wind the coiled tubing and spoke wheels 112 arranged on the two ends of the reel support 111, and the coiled tubing reel 10 comprises braking component 4 that are arranged on the frame-shaped base 3 at the sides of the drum 11 and capable of coming into contact with the spoke wheels 112 to restrain the movement of the drum 11. Moreover, to keep the drum 11 in a balanced stress state, braking components 4 may be arranged at the same side of the drum 11 near the two spoke wheels 112 respectively.

Figure 11:
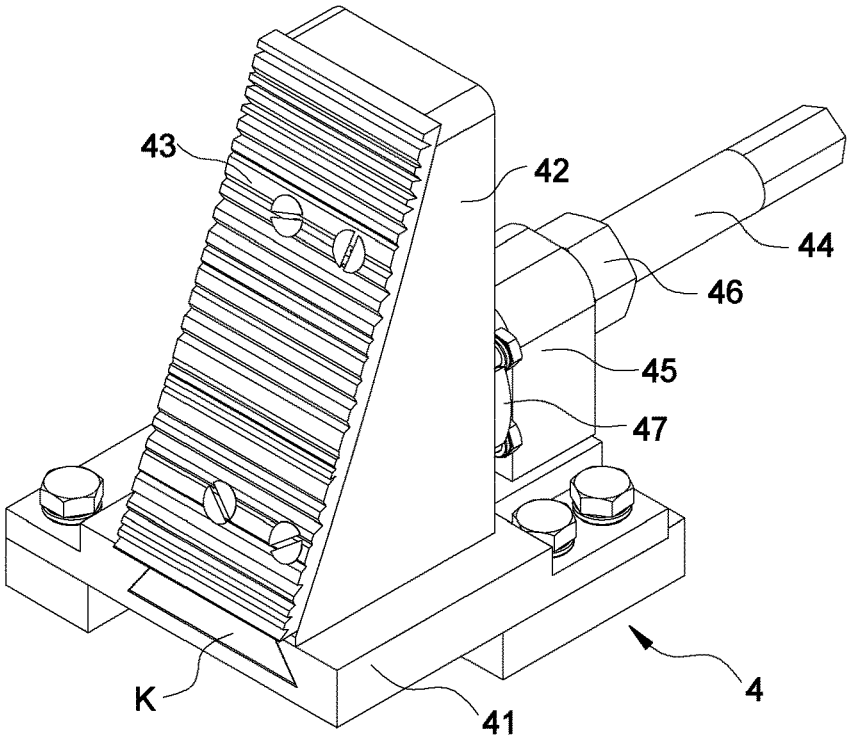
FIG. 11 is a schematic structural diagram of the braking component in the preferred embodiment of the present invention.

Wherein, preferably, as shown in FIG. 11, the braking component 4 comprises a mounting base 41, a slide block 42, a friction disk 43, a screw rod 44, and a supporting member 45 fixed with respect to the mounting base 41 (e.g., the supporting member 45 may be fixed to the mounting base 41), wherein the mounting base 41 is fixedly connected to the frame-shaped base 3, a slide track structure extending in the axial direction of the screw rod 44 is arranged between the slide block 42 and the mounting base 41, the friction disk 43 is arranged on the side of the slide block 42 that faces the spoke wheel 112, one end of the screw rod 44 is axially limited on the side of the slide block 42 that is opposite to the spoke wheel 112 and capable of rotating with respect to the slide block 42, and the other end of the screw rod 44 is fitted in the supporting member 45 via threads; moreover, to keep the friction disk 43 in a required position reliably, the braking component 4 further comprises a lock nut 46 arranged on the screw rod 44 at the side of the supporting member 45 away from the slide block 42. In that way, to restrain the rotation of the drum 11, the screw rod 44 may be turned with a wrench, so that the slide block 42 and the friction disk 43 move with respect to the mounting base 41 in the extension direction of the slide track structure (i.e., the axial direction of the screw rod 44) to a position where the friction disk 43 firmly abut against the periphery of the spoke wheel 112, and then the lock nut 46 on the screw rod 44 can be tightened up, i.e., the lock nut 46 comes into contact with the supporting member 45 to prevent sliding of the slide block 42 during transportation; to enable the drum 11 to rotate normally, the screw rod 44 may be turned with a wrench in a direction in which the friction disk 43 moves away from the spoke wheel 112 to a position where the friction disk 43 doesn't interfere with the spoke wheel 112, and then the lock nut 46 can be tightened up, so as to prevent the slide block 42 from sliding with respect to the mounting base 41 and thereby interfering with the spoke wheel 112.

Figure 12:
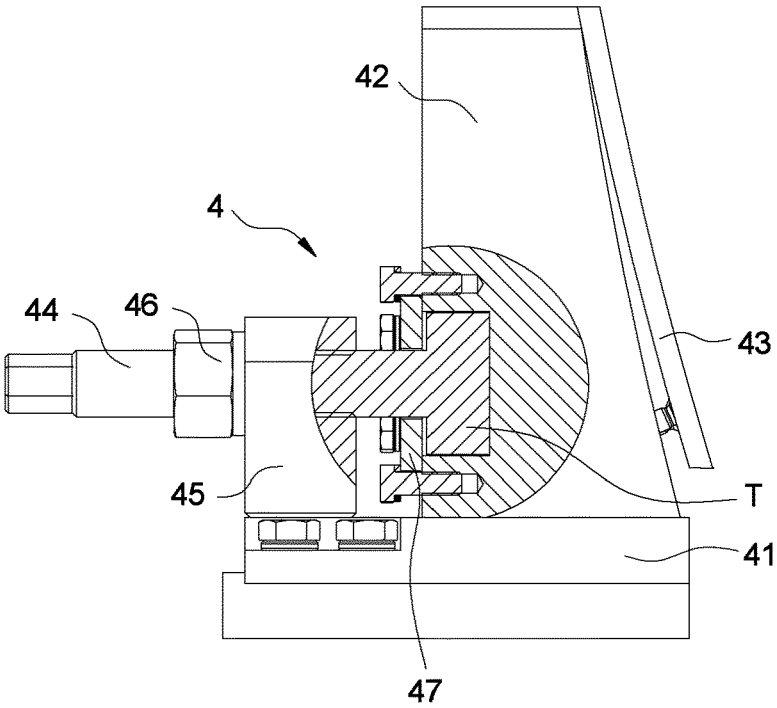
FIG. 12 is a broken-out sectional view of the braking component in the preferred embodiment of the present invention.

Furthermore, to increase the contact area between the mounting base 41 and the slide block 42 and enable the mounting base 41 and the slide block 42 to be in slide-fit with each other reliably via the slide track structure, as shown in FIG. 11, preferably, the slide track structure comprises a dovetail groove arranged in the mounting base 41 and a dovetail block K that is arranged on the slide block 42 and is in slide-fit with the dovetail groove. In addition, to enable one end of the screw rod 44 to be limited inside the slide block 42 in the axial direction and rotate with respect to the slide block 42, as shown in FIG. 12, preferably, the braking component 4 comprises a stopper 47, the slide block 42 is provided with an accommodating cavity, a flange T is arranged on the end of the screw rod 44 and rotatably disposed inside the accommodating cavity, the stopper 47 is fixedly connected to the slide block 42 and stops the flange T inside the accommodating cavity. Wherein, the stopper 47 may comprise a cover plate and fasteners that fixedly connect the cover plate to the slide block 42. Specifically, the fasteners may be screws.

Figure 13:
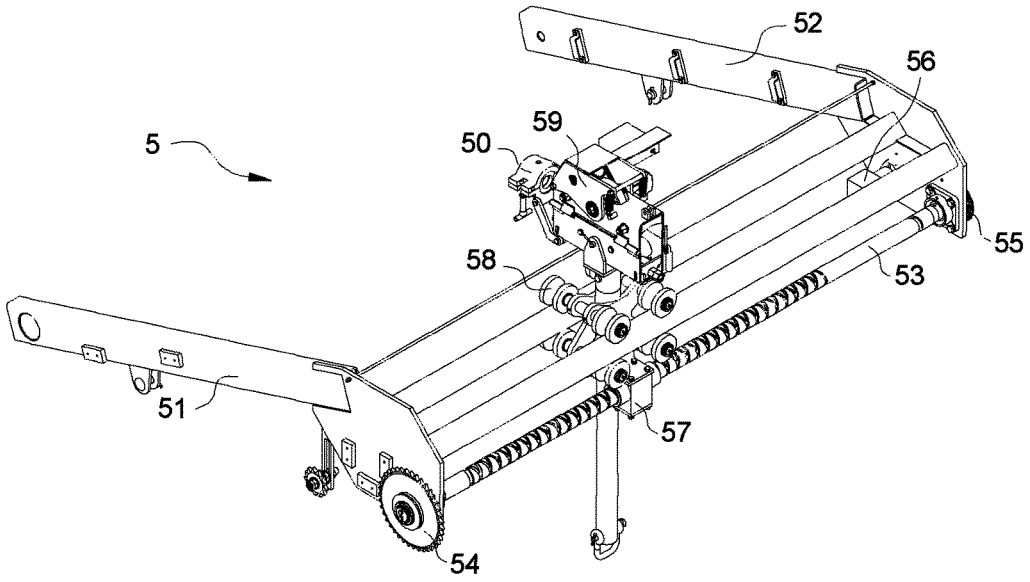
FIG. 13 is a schematic structural diagram of the levelwind assembly in the preferred embodiment of the present invention.

As shown in FIGS. 9, 10, and 13, preferably, the coiled tubing reel 10 comprises a levelwind (level wind) assembly 5 and a clutch component 6 fixedly connected to the first bearing block 14, wherein the levelwind assembly 5 comprises a first linking arm 51 and a second linking arm 52 that are oppositely arranged and a leadscrew 53 with two ends rotatably fitted with the first linking arm 51 and the second linking arm 52 respectively, the end of the first linking arm 51 that is away from the leadscrew 53 is rotatably fitted on the clutch component 6, the end of the second linking arm 52 that is away from the leadscrew 53 is hinged to the second bearing block 15, and the clutch component 6 is capable of moving the leadscrew 53 and the reel shaft 12 in association or not, the power skid 20 can supply power to the clutch component 6. In that way, automatic tubing alignment can be realized when the leadscrew 53 and the reel shaft 12 are in association via the clutch component 6; in a case that the coiled tubing is not aligned orderly, the leadscrew 53 and the reel shaft 12 may be not in association via the clutch component 6 so that a forced alignment motor 56 described below may be used to align the coiled tubing forcibly, to ensure the coiled tubing is aligned orderly and a required amount of coiled tubing can be wound on the drum 11.

Figure 14:
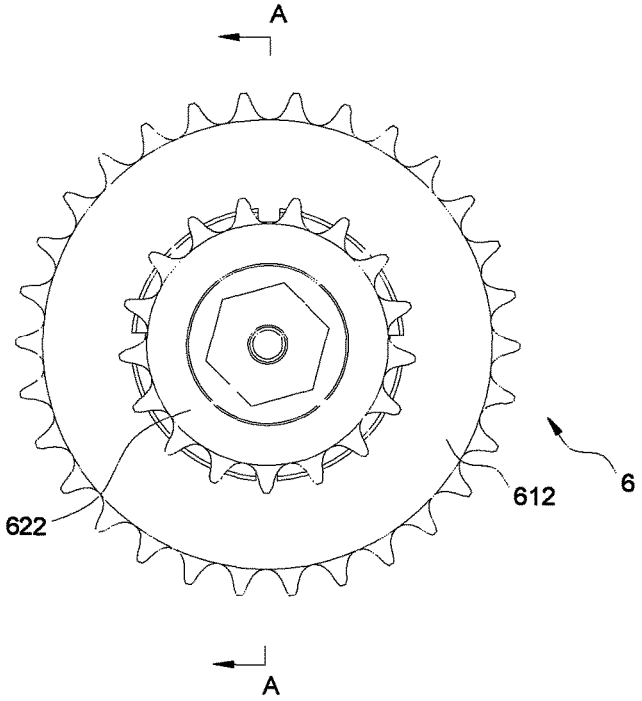
FIG. 14 is a schematic structural diagram of the clutch component in the preferred embodiment of the present invention.
Figure 15:
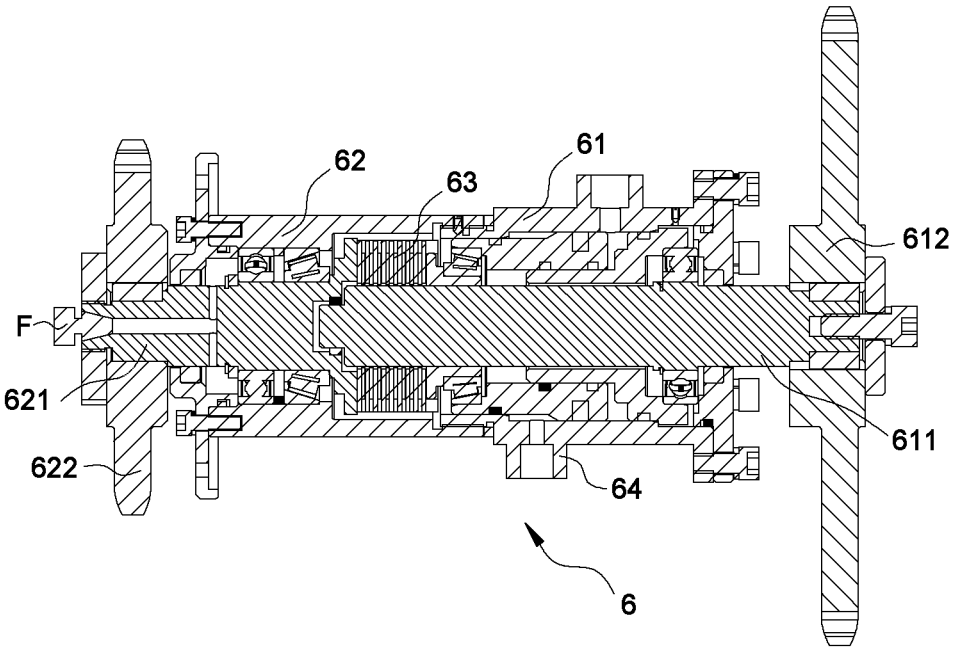
FIG. 15 is a sectional view A-A of the structure shown in FIG. 14.

Usually a mechanical overrun clutch is used for switchover between automatic tubing alignment and forced tubing alignment in coiled tubing reels at present. Such friction clutch controls the magnitude of the generated friction moment by means of the amount of compression of a Belleville spring, and the friction moment is greater than the moment required to drive the leadscrew 53 of the levelwind assembly 5 to rotate and smaller than the driving moment of the forced alignment motor 56. The amount of compression of the Belleville spring is adjusted by means of a bolt, but the bolt may get loose and the friction disk may be worn during use. Therefore, manual adjustment is often required. However, field adjustment is inconvenient and unsafe, and the magnitude of the friction moment is difficult to control. Especially, for high-strength large-diameter coiled tubing used in deep wells, it is more difficult to control the friction moment. Hence, it is desirable to develop a clutch component 6 applicable to alignment of high-strength coiled tubing. As shown in FIGS. 14 and 15, preferably, the clutch component 6 in the present application comprises a driving portion 61, a driven portion 62, and a clutch portion 63 that has an engaged state in which the driving portion 61 is engaged with the driven portion 62 and a disengaged state in which the driving portion 61 is disengaged from the driven portion 62, wherein the clutch portion 63 may be arranged between the driving portion 61 and the driven portion 62, the driving portion 61 is in a transmission connection with the reel shaft 12, the driven portion 62 is in a transmission connection with the leadscrew 53, and the clutch component 6 further comprises a switching portion 64 configured to control the clutch component 6 to switch between the engaged state and the disengaged state. Wherein, the switching portion 64 may be connected to a hydraulic control system which can arrange in the control cab 30, and the hydraulic control system control the clutch portion 63 to switch to the engaged state in which the driving portion 61 is engaged with the driven portion 62 or to the disengaged state in which the driving portion 61 is disengaged from the driven portion 62 through acting hydraulic pressure on the switching portion 64 by the power skid 20.

Further preferably, the driving portion 61 comprises a driving shaft 611 and a driving sprocket 612 mounted on the driving shaft 611; for example, the driving sprocket 612 is fitted on an outer end of the driving shaft 611 that is away from the driven portion 62, an end plate in diameter greater than the diameter of the driving shaft 611 may be mounted on the outer end of the driving shaft 611, and the end plate is fixedly connected to the driving shaft 611 by bolts to prevent the driving sprocket 612 from sliding off the driving shaft 611; the reel shaft 12 is provided with a transmission sprocket, and the driving sprocket 611 is connected to the transmission sprocket via chain; the driven portion 62 comprises a driven shaft 621 and a driven sprocket 622 mounted on the driven shaft 621; for example, the driven sprocket 622 is fitted on the outer end of the driven shaft 621 that is away from the driving portion 61, an end plate in diameter greater than the diameter of the driven shaft 621 may be fitted on the outer end of the driven shaft 621 via threads to prevent the driven sprocket 622 from sliding off the driven shaft 621, a hole in communication with the clutch portion 63 for lubricant flow may be arranged in the end surface of the outer end of the driven shaft 621, and the hole may be sealed by means of a check valve F; the levelwind assembly 5 comprises a first sprocket 54 and a second sprocket 55 that are fixedly connected to the two ends of the leadscrew 53 respectively, and the driven sprocket 621 is connected to the first sprocket 54 via chain; the levelwind assembly 5 is provided with a forced alignment motor 56, and the forced alignment motor 56 is connected to the second sprocket 55 via chain. In addition, a slide tongue box assembly 57 is fitted on the leadscrew 53, a roller bogie 58 is fixedly connected on the slide tongue box assembly 57, the first linking arm 51 and the second linking arm 52 are provided with slide tracks that extend in the same direction as the leadscrew 53 to guide the roller bogie 58 to slide, and an adjustable counter 59 and a lubricant box 50 are mounted on the roller bogie 58. Quick switchover between automatic tubing alignment and manual forced tubing alignment can be realized via the clutch component 6, and thereby manual adjustment can avoided, adjustment time can be reduced, labor intensity can be decreased, and operation convenience, safety and reliability can be improved.

As shown in FIGS. 9 and 10, preferably, an elevating component 7 configured to elevate the levelwind assembly 5 is arranged between the first linking arm 51 and the first bearing block 14 and between the second linking arm 52 and the second bearing block 15 respectively. Wherein, the elevating component 7 may be connected to one of the first linking arm 51, the first bearing block 14, the second linking arm 52, and the second bearing block 15, and the elevating component 7 may be a hydraulic cylinder.

The operating process of the coiled tubing reel 10 in the present invention is as follows: the hydraulic motor 22 is driven by hydraulic power (e.g., supplied by the power skid) to drive the driving gear 21 via the reducer 23 to rotate, the driving gear 21 is engaged with the transmission gear 13 that is fixed with respect to the reel shaft 12 and thereby drives the drum 11 that is fixedly fitted on the reel shaft 12 to rotate; in the case of automatic tubing alignment, the driven portion 62 and the driving portion 61 of the clutch component 6 are driven by the hydraulic power at the same time to engage with each other via the clutch portion 63 (i.e., the clutch portion 63 is in an engaged state), the reel shaft 12 rotates and drives the transmission sprocket on it to rotate, the transmission sprocket drives the driving sprocket 612 on the driving shaft 611 via chain to rotate and drive the driven shaft 621 and the driven sprocket 622 on the driven shaft 621 to rotate together, the driven sprocket 622 drives the first sprocket 54 via chain to rotate, and thereby the leadscrew 53 rotates, so that the slide tongue box assembly 57 and the roller bogie 58 move to and fro along the length direction of the leadscrew 53, and drive the coiled tubing mounted on the adjustable counter 59 to align uniformly on the drum 11. In the case that the coil tubing is not aligned orderly, the clutch component 6 is driven by hydraulic power to drive the driven shaft 621 and the driving shaft 611 to disengage from each other via the clutch portion 63; now the driving sprocket 612 and the driven sprocket 622 are not in assosiation with each other; then, the forced alignment motor 56 on the levelwind assembly 5 is driven by hydraulic power to drive the second sprocket 55 and the leadscrew 53 to rotate, so that the slide tongue box assembly 57 and the roller bogie 58 are driven to move to and fro in the length direction of the leadscrew 53; after the coil tubing is aligned orderly, the rotation of the forced alignment motor 56 is stopped, and the clutch component 6 is driven by hydraulic power to drive the driven shaft 621 and the driving shaft 611 to engage with each other via the clutch portion 63, and thereby automatic tubing alignment is enabled.

While the present invention is described above in detail in some preferred embodiments with reference to the accompanying drawings, the present invention is not limited to those embodiments.

Various simple variations may be made to the technical scheme in the present invention, including combinations of the specific technical features in any appropriate form, within the scope of the technical ideal of the present invention. To avoid unnecessary repetition, the possible combinations are not described specifically in the present invention. However, such simple variations and combinations shall also be deemed as having been disclosed in the present invention and falling in the scope of protection of the present invention.

The invention claimed is:

1. A coiled tubing unit, comprising a vehicle body (T), a control cab (30), a coiled tubing reel (10) configured to wind coiled tubing, and a power skid (20) configured to supply power to the coiled tubing reel (10) and transported separately, wherein, the coiled tubing reel (10) and the control cab (30) are mounted on the vehicle body (T), wherein, the power skid (20) comprises a diesel engine (201), a transfer case (202), a hydraulic pump (203), a hydraulic oil tank (204), an accumulator (205), a generator (206), a power hose reel (207), and a short pipeline hose reel (208), the short pipeline hose reel (208) is configured to wind hydraulic pipelines between the power skid (20) and the coiled tubing reel (10), wherein the diesel engine (201) is connected with the transfer case (202), the hydraulic pump (203) is mounted on the transfer case (202), the hydraulic oil tank (204) is mounted above the hydraulic pump (203), the power hose reel (207) and the short pipeline hose reel (208) are mounted on a first side of the power skid (20), the generator (206) is mounted between the short pipeline hose reel (208) and the diesel engine (201), and the accumulator (205) is mounted on a second side of the power skid (20) opposite to the first side.

2. The coiled tubing unit according to claim 1, wherein, a control hose reel (40) is further mounted on the vehicle body (T), the control cab (30) and the control hose reel (40) are mounted on opposite sides of the coiled tubing reel (10) respectively, and the control cab (30) is mounted near a front portion of the vehicle body (T) away from the tail end of the vehicle body (T).

3. The coiled tubing unit according to claim 1, wherein, the coiled tubing unit comprises a transport skid (500) on which an injection head (501), a gooseneck (502), a blowout preventer (503), a stripper (504), and a lubricator (505) can be disposed together and transported integrally, and the power skid (20) can supply power to the injection head (501), the stripper (504), and the blowout preventer (503) on the transport skid (500).

4. The coiled tubing unit according to claim 3, wherein, the gooseneck (502) is mounted on the top of the injection head (501), the stripper (504) is mounted on the bottom of the injection head (501), the blowout preventer (503) and the lubricator (505) are mounted on two sides of the gooseneck (502) respectively, and the lubricator (505) can be connected to the blowout preventer (503) and the stripper (504) respectively during operation.

5. The coiled tubing unit according to claim 1, wherein, the coiled tubing reel (10) comprise a drum assembly (1) configured to wind a coiled tubing and a driving component (2) configured to drive the drum assembly (1), wherein, the power skid (20) can supply power to the driving component (2), the drum assembly (1) comprises a drum (11), a reel shaft (12), a transmission gear (13), and a first bearing block (14) and a second bearing block (15) that are oppositely arranged and spaced from each other and are fixed relative to the vehicle body (T), wherein the drum (11) is fixedly fitted on the reel shaft (12), the two ends of the reel shaft (12) are rotatably arranged on the first bearing block (14) and the second bearing block (15) respectively, the transmission gear (13) is fixed with respect to the reel shaft (12) to drive the reel shaft (12) to rotate, the driving component (2) is fixedly arranged on the first bearing block (14) and is at least partially disposed inside the drum (11), and the driving component (2) comprises a driving gear (21) that is engaged with the transmission gear (13).

6. The coiled tubing unit according to claim 5, wherein, the drum assembly (1) comprises a flange that is fixedly fitted on the reel shaft (12) and fixedly connected to the drum (11), and the transmission gear (13) is fitted on the reel shaft (12) and fixedly connected to the flange; the drum assembly (1) further comprises a housing (16) that is arranged outside the driving gear (21) and the transmission gear (13); the housing (16) accommodates lubricant in it and is fixed with respect to the first bearing block (14), and the housing (16) has an opening, the flange extends out from the opening, and there is clearance between the flange and the opening.

7. The coiled tubing unit according to claim 6, wherein, the drum (11) comprises a reel support (111) configured to wind the coiled tubing and spoke wheels (112) arranged on the two ends of the reel support (111), the reel support (111)

comprises an annular cylinder (1111) and a plurality of radial columns (1112) that are arranged at an interval in the circumferential direction of the annular cylinder (1111) and extend in the radial direction of the annular cylinder (1111), the two ends of each radial column (1112) are fixedly connected to the annular cylinder (1111) and the reel shaft (12) respectively, and the flange is fixedly connected to the radial columns (1112); and/or, the reel support (111) further comprises a plurality of axial columns (1113) that are arranged at an interval in the circumferential direction of the annular cylinder (1111) and extend in the axial direction of the annular cylinder (1111) and/or a plurality of circumferential columns (1114) that are arranged at an interval in the axial direction of the annular cylinder (1111) and extend in the circumferential direction of the annular cylinder (1111).

8. The coiled tubing unit according to claim 5, wherein, the coiled tubing reel (10) comprises a frame-shaped base (3) fixed relative to the vehicle body (T), the drum (11) is fitted inside the frame-shaped base (3), and the first bearing block (14) and the second bearing block (15) are arranged on two opposite side edges of the frame-shaped base (3); the drum (11) comprises a reel support (111) configured to wind the coiled tubing and spoke wheels (112) arranged on the two ends of the reel support (111), and the coiled tubing reel (10) comprises braking components (4) that are arranged on the frame-shaped base (3) at the sides of the drum (11) and capable of coming into contact with the spoke wheels (112) to restrain the movement of the drum (11).

9. The coiled tubing unit according to claim 8, wherein, the braking component (4) comprises a mounting base (41), a slide block (42), a friction disk (43), a screw rod (44), and a supporting member (45) fixed with respect to the mounting base (41), the mounting base (41) is fixedly connected to the frame-shaped base (3), a slide track structure extending in the axial direction of the screw rod (44) is arranged between the slide block (42) and the mounting base (41), the friction disk (43) is arranged on the side of the slide block (42) that faces the spoke wheel (112), one end of the screw rod (44) is axially limited on the side of the slide block (42) that is opposite to the spoke wheel (112) and capable of rotating with respect to the slide block (42), and the other end of the screw rod (44) is fitted in the supporting member (45) via threads; the braking component (4) further comprises a lock nut (46) arranged on the screw rod (44) at the side of the supporting member (45) that is away from the slide block (42).

10. The coiled tubing unit according to claim 9, wherein, the slide track structure comprises a dovetail groove arranged in the mounting base (41) and a dovetail block (K) that is arranged on the slide block (42) and in slide-fit with the dovetail groove; and/or the braking component (4) comprises a stopper (47), the slide block (42) is provided with an accommodating cavity, a flange (T) is arranged on an end of the screw rod (44) and rotatably disposed inside the accommodating cavity, the stopper (47) is fixedly connected to the slide block (42) and stops the flange (T) inside the accommodating cavity.

11. The coiled tubing unit according to claim 5, wherein, the coiled tubing reel (10) comprises an levelwind assembly (5) and a clutch component (6) fixedly connected to the first bearing block (14), the levelwind assembly (5) comprises a first linking arm (51) and a second linking arm (52) that are oppositely arranged and a leadscrew (53) with two ends rotatably fitted with the first linking arm (51) and the second linking arm (52) respectively, the end of the first linking arm (51) that is away from the leadscrew (53) is rotatably fitted on the clutch component (6), the end of the second linking arm (52) that is away from the leadscrew (53) is hinged to the second bearing block (15), the clutch component (6) is capable of moving the leadscrew (53) and the reel shaft (12) in association or not, the power skid (20) can supply power to the clutch component (6).

12. The coiled tubing unit according to claim 11, wherein, the clutch component (6) comprises a driving portion (61), a driven portion (62), and a clutch portion (63), the clutch portion (63) has an engaged state in which the driving portion (61) is engaged with the driven portion (62) and a disengaged state in which the driving portion (61) is disengaged from the driven portion (62), wherein the driving portion (61) is in a transmission connection with the reel shaft (12), the driven portion (62) is in a transmission connection with the leadscrew (53), and the clutch component (6) further comprises a switching portion (64) configured to control the clutch component (6) to switch between the engaged state and the disengaged state.

13. The coiled tubing unit according to claim 12, wherein, the driving portion (61) comprises a driving shaft (611) and a driving sprocket (612) mounted on the driving shaft (611), the reel shaft (12) is provided with a transmission sprocket, and the driving sprocket (611) is connected to the transmission sprocket via chain; the driven portion (62) comprises a driven shaft (621) and a driven sprocket (622) mounted on the driven shaft (621); the levelwind assembly (5) comprises a first sprocket (54) and a second sprocket (55) that are fixedly connected to the two ends of the leadscrew (53) respectively, and the driven sprocket (621) is connected to the first sprocket (54) via chain; the levelwind assembly (5) is provided with a forced alignment motor (56), and the forced alignment motor (56) is connected to the second sprocket (55) via chain.

14. The coiled tubing unit according to claim 11, wherein, an elevating component (7) configured to elevate the levelwind assembly (5) is arranged between the first linking arm (51) and the first bearing block (14) and between the second linking arm (52) and the second bearing block (15) respectively.

* * * * *